United States Patent [19]

Kleinemas

[11] Patent Number: 4,810,128

[45] Date of Patent: Mar. 7, 1989

[54] LEVELLING DEVICE FOR PRODUCING A SMOOTH SURFACE

[76] Inventor: Harald Kleinemas, Marktstrasse 8, Ramsloh, D-2915 Saterland 1, Fed. Rep. of Germany

[21] Appl. No.: 30,950

[22] Filed: Mar. 26, 1987

[30] Foreign Application Priority Data

Apr. 4, 1986 [DE] Fed. Rep. of Germany ..... 3611323

[51] Int. Cl.[4] ..... E01C 19/24

[52] U.S. Cl. ..... 404/97; 404/119; 425/458

[58] Field of Search ..... 404/96–98, 404/101, 104–107, 118–120; 425/456, 458

[56] References Cited

U.S. PATENT DOCUMENTS

| | | | |
|---|---|---|---|
| 2,976,784 | 3/1961 | Perkins et al. | 404/119 |
| 3,118,353 | 1/1964 | Neil | 404/114 |
| 3,182,410 | 5/1965 | Schiavi | 404/96 X |
| 3,418,902 | 12/1968 | Wilson | 404/119 X |
| 4,340,351 | 7/1982 | Owens | 404/118 X |
| 4,397,581 | 8/1983 | Jarvis | 404/97 |
| 4,544,346 | 10/1985 | Allen | 404/119 X |
| 4,591,291 | 5/1986 | Owens | 404/97 X |
| 4,641,995 | 2/1987 | Owens | 404/97 X |

FOREIGN PATENT DOCUMENTS

| | | | |
|---|---|---|---|
| 761296 | 3/1934 | France | 404/118 |

*Primary Examiner*—Jerome W. Massie
*Assistant Examiner*—John F. Letchford
*Attorney, Agent, or Firm*—Jordan and Hamburg

[57] ABSTRACT

A levelling device for producing a smooth surface on a sett paving bed is constructed, with a view to easy handling and neat working, so that the rule can lift the excess material with a cutting action by a projecting cutting edge and a rising ramp surface. With a collecting trough and with rollers to support the levelling rule, a transport truck for excess material can be provided at the same time.

1 Claim, 1 Drawing Sheet

LEVELLING DEVICE FOR PRODUCING A SMOOTH SURFACE

The invention relates to a levelling device for producing a smooth surface.

Levelling boards of wood or metal are typically used for levelling a surface for sett paving work, these being displaced, transversely to themselves, along the top of the previously compacted formation. In this case, guiding laths must previously be sunk in the formation so that their upper edge lies at the level of the smooth surface to be produced. Working with these levelling boards is inconvenient and arduous if only because the bed material for the sett paving, such as sand for example, has to be pushed out from a crouching or kneeling working position.

Levelling devices have also been developed already which can be handled by means of handles and are accordingly intended for use in an upright working position.

Finally, levelling boards have already been developed for mounting on mechanical implements but these presuppose corresponding mechanical expenditure and in addition cause special problems with deformation of the subsoil as a result of the weight of the implements on the formation.

In each of the known cases, problems result, in particular, with the excess material which is pushed onto the compacted material and has to be removed from there so that regions of unequal density easily result. As a result, the necessity for finishing work often arises. Filling in and touching up are also regularly necessary after guiding laths have been taken out of the finished formation.

It is the object of the invention to provide a levelling device which is easy to handle and enables a smooth surface to be produced in a rapid procedure which makes finishing work largely superfluous.

The present invention is a levelling device for producing a smooth formation on a sett paving bed, having a levelling rule which is movable transversely to itself along guiding laths or the like levelling aids, the levelling rule comprising a cutting edge on a ramp surface which extends upwardly from the cutting edge to a collecting trough.

The levelling device according to the invention departs from the traditional levelling with a substantially perpendicular levelling surface and changes over to a cutting or paring removal motion to which the material of the bed for the sett paving offers considerably less resistance. Furthermore, it is provided that the excess material is not pushed up in front of the levelling rule where it therefore offers additional resistance but is lifted up and received in a collecting trough.

Apart from the reduction in the forces to be applied during the levelling movement, this has the particular advantage that the precompacted rough formation is not covered with loose material and that compacted material is also lifted during the removal of pushed-up excess material. The material here remaining behind the levelling device is, instead, of a uniform density.

It is particularly advantageous to support the levelling rule on rollers which make it easier to carry away excess material, which has accumulated in the collecting trough, with the levelling device. The rollers may also facilitate support on guiding laths or the like levelling aids during the levelling movement.

For the support on guiding laths, provision may appropriately be made for the rollers to be adjustable in height in relation to the levelling rule, the adjusting range usually being such that the roller as a whole lies above the cutting edge of the levelling rule. Guiding laths can then be arranged on the surface of a rough formation so that the cutting edge extends below the lower edge of these guiding laths. Similarly, guiding laths can also be laid on a strip of smooth formation which has already been finished, on sett paving already present or the like - the adjustment in height enables a smooth formation to be produced at the desired level. The latter also applies in the case where, during the production of a smooth formation strip by strip, there is a rough formation on one side and a smooth formation which is already finished at the other side or where kerbstone edges at one side serve as a reference level and levelling aid.

An embodiment of the present invention will now be described, by way of example, with reference to the accompanying drawing.

DESCRIPTION OF THE PREFERRED EMBODIMENTS

Figure 1:
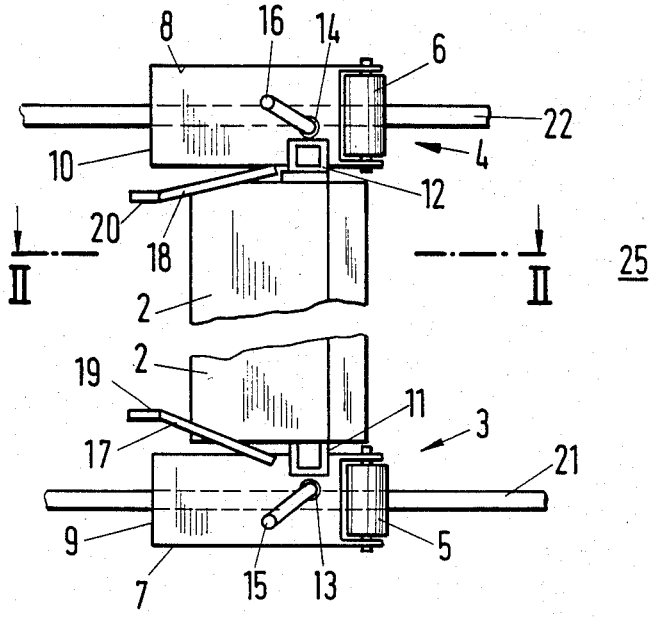
FIG. 1 shows a plan view of a levelling device (with the central portion broken away)

The levelling device, which is designated as a whole by 1 in the drawing, comprises a levelling rule 2 which is typically extended over several meters and the centre portion is only shown broken away for reasons of illustration. The levelling rule is supported, at each of its two lateral ends, on a supporting device 3 or 4 respectively, each of which comprises, at the back, a roller 5 or 6 respectively which is mounted in a frame 7 or 8 respectively which extends in a predominantly horizontal plane and forms a sensing edge 9 or 10 at the front. The supporting devices 3 and 4 are each connected to the levelling rule 2 for adjustment in height through a column 11, 12 which is directed predominantly vertically and has a spindle 13, 14 and a crank handle 15, 16 at the top for the spindle. The frames 7, 8 are further connected, through links 17, 18, to handles 19, 20 at the ends, which enable the device to be handled in an upright attitude.

The levelling device can now be moved over guiding laths 21, 22, similarly to a conventional levelling board, in order, on movement in the direction of an arrow 23, to form out of a rough formation 24 in front of the levelling device, a smooth formation 25 behind this. Certainly it is no longer necessary for the guiding laths or other levelling aids to be sunk below the required level of the smooth formation and instead the elevated arrangement of the rollers 5, 6 and in particular of the sensing edges 7, 8 also renders possible the use of higher reference edges. Accordingly, the edges of the sett pavements which have already been laid, kerbstone edges extending parallel and the like may also be used. The offsetting in height between the upper edge of the smooth formation and the upper edge of the guiding lath 21 or 22 can be seen, inter alia, from FIGS. 2 and 3, and the laths do not need to lie at the same height and instead reference heights offset in relation to one another can also be used—particularly with various levelling aids.

During work, both the sensing edge 9 or 10 and the roller 5 or 6 of the supporting devices 3, 4 lie on the associated guiding lath 21 or 22, the sensing edge 9 or 10 determining the adjustment in height because it is adjacent to the lowest region of the levelling rule. In the example of embodiment illustrated, the sensing edge executes a scraping movement which has the advantage over the rolling motion possible as an alternative that sand or the like material of the bed of the sett paving is stripped off the guiding lath 21 or 22 on which it is lying. It is understood that a two-point support at both sides with levelling rule and roller can also be replaced by a single-point support, whether scraping or rolling, provided this is arranged substantially perpendicular to the lowest region of the levelling rule. Certain variations in the setting angle then do not have an appreciable effect on the level of the smooth formation.

Figure 2:
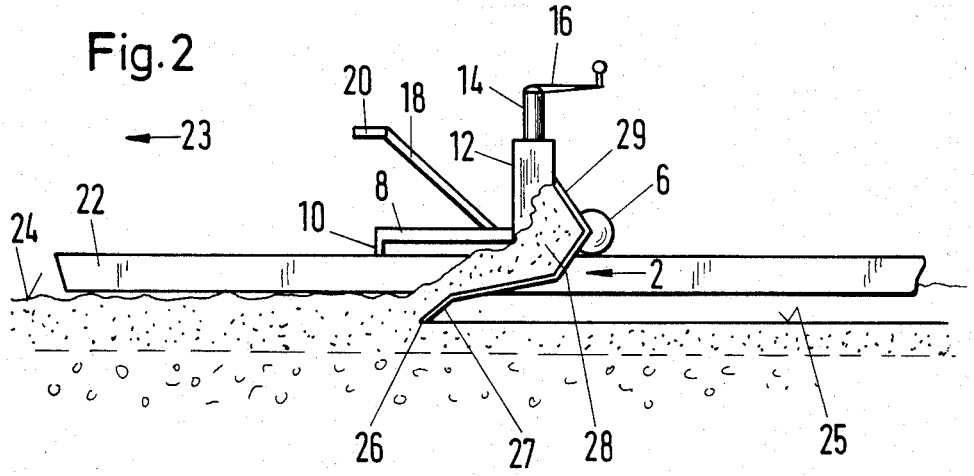
FIG. 2 shows a section on line II—II in FIG. 1.
Figure 3:
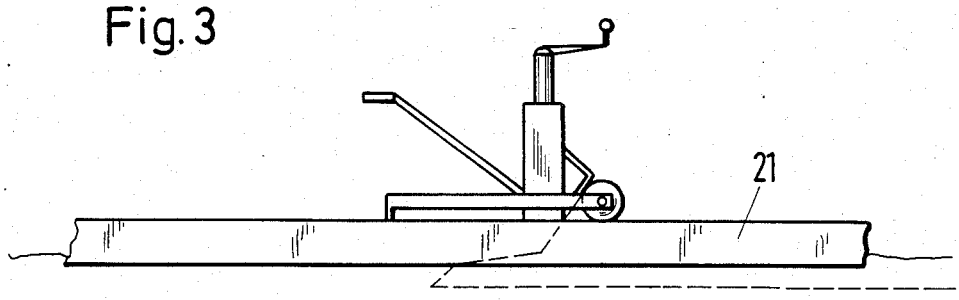
FIG. 3 shows a side view of the levelling device, seen in the same direction as in FIG. 2.

FIG. 2 shows the advantageous shape of the levelling rule which is made from a metal plate bent at an angle, particularly for reasons of weight. On movement in the direction of the arrow 23, contact of the levelling rule 2 is first made by a cutting edge 26 behind which the plate, rising obliquely, offers a ramp surface 27. Thus it is possible to lift the sand or other bed material of the sett paving above the level line without the material being pushed or rolled forwards. A collecting trough 28, which is bounded at the back by a back plate 29 set steeply, is formed behind the ramp surface 27 to receive the material lifted up. Thus the material can be picked up and does not fall back onto the freshly prepared smooth formation.

As soon as the trough is full, the levelling device 1 can be used as a whole as a truck and can be moved on the rollers 5, 6 in order to convey the excess bed material of the sett paving away.

The levelling device thus provided is relatively easy to construct as a whole, particularly as the middle region of the levelling rule 2, which is broken away in the drawing for reasons of illustration, determines the greater part of the dimensions. Such a device, which is operated by hand, has proved advantageous because it renders easy and neat work possible so that the use of mechanical levelling aids, which lead to special problems from the point of view of expense and net weight, can be dispensed with.

The levelling rule can be subdivided in length, the sectional shape facilitating an inherently stable, areal connection. The possibility is thus also afforded of pushing the divided shaped plates together or pulling them apart in order to produce different widths. A preferred form of embodiment provides for a trisection of the plates so that a symmetrical construction with a centre portion and two lateral portions arranged symmetrically in relation to this results for the levelling rule 2. The connection can be effected by conventional screw connections or other clamping devices. It is also possible, however, to fit bracing behind the back plate for a spindle or cable line adjustment.

I claim:

1. A hand operated levelling device for producing a smooth formation on a sett paving bed while manually being moved along longitudinally extending guiding aids disposed along side edges of said paving bed, the levelling device comprising a pair of spaced supporting means each mounting a roller which rolls on said guiding aids, levelling rule means extending between and mounted on said supporting means, said supporting means comprising adjustment means operably connected to said levelling rule means for adjusting the height of said levelling rule means relative to said supporting means, said levelling rule means being elongated and having a generally elongate axis which is disposed transversely to the longitudinal extent of said longitudinally extending guiding aids, said levelling rule means having a ramp section and a trough section, said ramp section having a cutting edge disposed such that as the levelling device moves along said guiding aids, said cutting edge engages the paving material and passes the excess paving material onto said ramp section and into said trough section, each of said support means having a guide arm rigidly connected thereto which has a sensing edge means spaced from said roller on the respective supporting means, said sensing edge means being located ahead of said rollers considered in the direction of movement of the levelling device along said guiding aids, said sensing edge means overlying and engaging the respective guiding aid such that the engagement of the respective roller and sensing edge means with the respective guiding aid defines a working orientation position of the levelling device and also defines the minimal elevational position of said cutting edge relative to said guiding aids, said ramp section sloping upwardly from said cutting edge when the levelling device is in said working orientation position, said cutting edge being disposable at a lower elevation than said upper surface of said guiding aids when the levelling device is in said working orientation position, and handle means on the levelling device adapted to be manually gripped to pivot the levelling device about the axes of said rollers from said working orientation position to another pivotal position in which said cutting edge is disposed above the paving bed and said sensing edge means is disposed above said guiding aids such that the levelling device may be manually rolled on said rollers along said guiding aids to a desired location for emptying of the paving material from said trough section.

* * * * *